US006068552A

United States Patent [19]

Walker et al.

[11] Patent Number: 6,068,552

[45] Date of Patent: May 30, 2000

[54] GAMING DEVICE AND METHOD OF OPERATION THEREOF

[75] Inventors: Jay S. Walker, Ridgefield; James A. Jorasch, Stamford; Magdalena Mik, Wallingford, all of Conn.

[73] Assignee: Walker Digital, LLC, Stamford, Conn.

[21] Appl. No.: 09/052,291

[22] Filed: Mar. 31, 1998

[51] Int. Cl.[7] ..... A63F 9/22

[52] U.S. Cl. ..... 463/21; 463/13; 463/20; 273/139

[58] Field of Search ..... 463/1, 11–13, 463/16–20, 21–22, 25, 26, 30, 36, 40, 42; 273/138.1, 138.2, 139, 292, 293, 143 R, 121 B

[56] References Cited

U.S. PATENT DOCUMENTS

| | | |
|---|---|---|
| 4,448,419 | 5/1984 | Telnaes . |
| 4,679,143 | 7/1987 | Hagiwara et al. . |
| 4,695,053 | 9/1987 | Vazquez, Jr. et al. . |
| 4,991,848 | 2/1991 | Greenwood et al. . |
| 5,123,649 | 6/1992 | Tiberio . |
| 5,259,616 | 11/1993 | Bergmann . |
| 5,275,400 | 1/1994 | Weingardt et al. . |
| 5,277,424 | 1/1994 | Wilms . |
| 5,401,023 | 3/1995 | Wood . |
| 5,494,287 | 2/1996 | Manz . |
| 5,511,784 | 4/1996 | Furry et al. . |
| 5,639,088 | 6/1997 | Schneider et al. . |
| 5,655,961 | 8/1997 | Acres et al. . |
| 5,704,835 | 1/1998 | Dietz et al. . |

OTHER PUBLICATIONS

Brewer, Kathleen Pearl, et al., "Gaming Getting a Handle on Slots." Information Access Company, Apr., 1995 at vol. 36; No. 2; pg. 74.

Bob Rose, "New Ways for House to Win", St. Louis Post–Dispatch, Oct. 3, 1996 at p. 50.

*Primary Examiner*—Mark A. Sager

*Attorney, Agent, or Firm*—Dean Alderucci; Kurt M. Maschoff

[57] ABSTRACT

A gaming device such as a video based slot machine provides a player the ability to modify at least one parameter of the slot machine. The slot machine then modifies other parameters to ensure a desired house advantage. Odds, payout schedules and wager amounts may be customized by a player, and the slot machine automatically determines changes in other parameters which were not customized to maintain a constant house advantage. Software running on the slot machine uses an equation that takes into account pertinent parameters or variables such as size of jackpot, amount wagered taken in at each pull, and probability of hitting the jackpot at each pull. Based on the equation, the software adjusts parameters other than the one(s) specified by the player so that the outcome (the house advantage) remains constant with each pull. A player interface provides an easy to use method of modifying selected parameters.

25 Claims, 15 Drawing Sheets

1010

| OUTCOME 1012 | DEFAULT PAYOUTS 1014 | CUSTOMIZED PAYOUTS 1016 |
|---|---|---|
| CHERRY/ANY/ANY | 2 | 2 |
| ANY/ANY/CHERRY | 2 | 2 |
| CHERRY/CHERRY/ANY | 5 | 5 |
| ANY/CHERRY/CHERRY | 5 | 5 |
| CHERRY/ANY/CHERRY | 5 | 5 |
| CHERRY/CHERRY/CHERRY | 20 | 15 |
| BAR/ORANGE/ORANGE | 10 | 10 |
| ORANGE/ORANGE/BAR | 10 | 10 |
| ORANGE/ORANGE/ORANGE | 20 | 20 |
| BAR/PLUM/PLUM | 14 | 14 |
| PLUM/PLUM/BAR | 14 | 14 |
| PLUM/PLUM/PLUM | 20 | 20 |
| BAR/BELL/BELL | 18 | 18 |
| BELL/BELL/BAR | 18 | 18 |
| BELL/BELL/BELL | 20 | 20 |
| BAR/BAR/BAR | 50 | 50 |
| 7/7/7 | 100 | 200 |

1022

1020

FIG. 10

1100

| OUTCOME 1112 | DEFAULT PAYOUTS 1114 | CUSTOMIZED PAYOUTS 1116 |
|---|---|---|
| CHERRY/ANY/ANY | 2 | 2 |
| ANY/ANY/CHERRY | 2 | 2 |
| CHERRY/CHERRY/ANY | 5 | 5 |
| ANY/CHERRY/CHERRY | 5 | 5 |
| CHERRY/ANY/CHERRY | 5 | 5 |
| CHERRY/CHERRY/CHERRY | 20 | 20 |
| BAR/ORANGE/ORANGE | 10 | 10 |
| ORANGE/ORANGE/BAR | 10 | 10 |
| ORANGE/ORANGE/ORANGE | 20 | 20 |
| BAR/PLUM/PLUM | 14 | 14 |
| PLUM/PLUM/BAR | 14 | 14 |
| PLUM/PLUM/PLUM | 20 | 40 |
| BAR/BELL/BELL | 18 | 18 |
| BELL/BELL/BAR | 18 | 18 |
| BELL/BELL/BELL | 20 | 20 |
| BAR/BAR/BAR | 50 | 100 |
| 7/7/7 | 100 | 50 |

1119

1118

1117

FIG. 11A

1120

| OUTCOME 1122 | DEFAULT | | CUSTOMIZATION | |
|---|---|---|---|---|
| | RANDOM NUMBER 1124 | EXPECTED HITS PER CYCLE 1126 | RANDOM NUMBER 1128 | EXPECTED HITS PER CYCLE 1130 |
| NONWINNING COMBINATION | 1-8570 | 8570 | 1-8604 | 8604 |
| CHERRY/ANY/ANY | 8571-9250 | 680 | 8605-9284 | 680 |
| ANY/ANY/CHERRY | 9251-9930 | 680 | 9285-9964 | 680 |
| CHERRY/CHERRY/ANY | 9931-10130 | 200 | 9965-10164 | 200 |
| ANY/CHERRY/CHERRY | 10131-10330 | 200 | 10165-10364 | 200 |
| CHERRY/ANY/CHERRY | 10331-10398 | 68 | 10365-10432 | 68 |
| CHERRY/CHERRY/CHERRY | 10399-10418 | 20 | 10433-10452 | 20 |
| BAR/ORANGE/ORANGE | 10419-10460 | 42 | 10453-10494 | 42 |
| ORANGE/ORANGE/BAR | 10461-10466 | 6 | 10495-10500 | 6 |
| ORANGE/ORANGE/ORANGE | 10467-10508 | 42 | 10501-10542 | 42 |
| BAR/PLUM/PLUM | 10509-10528 | 20 | 10543-10562 | 20 |
| PLUM/PLUM/BAR | 10529-10533 | 5 | 10563-10567 | 5 |
| PLUM/PLUM/PLUM | 10534-10583 | 50 | 10568-10592 | 25 |
| BAR/BELL/BELL | 10584-10587 | 4 | 10593-10596 | 4 |
| BELL/BELL/BAR | 10588-10607 | 20 | 10597-10616 | 20 |
| BELL/BELL/BELL | 10608-10627 | 20 | 10617-10636 | 20 |
| BAR/BAR/BAR | 10628-10647 | 20 | 10637-10646 | 10 |
| 7/7/7 | 10648 | 1 | 10647-10648 | 2 |

1139

1138

1137

FIG. 11B

1200

| OUTCOME 1210 | DEFAULT PAYOUTS 1212 | CUSTOMIZED PAYOUTS 1214 |
|---|---|---|
| CHERRY/ANY/ANY | 2 | 2 |
| ANY/ANY/CHERRY | 2 | 2 |
| CHERRY/CHERRY/ANY | 5 | 5 |
| ANY/CHERRY/CHERRY | 5 | 5 |
| CHERRY/ANY/CHERRY | 5 | 5 |
| CHERRY/CHERRY/CHERRY | 20 | 20 |
| BAR/ORANGE/ORANGE | 10 | 10 |
| ORANGE/ORANGE/BAR | 10 | 10 |
| ORANGE/ORANGE/ORANGE | 20 | 20 |
| BAR/PLUM/PLUM | 14 | 14 |
| PLUM/PLUM/BAR | 14 | 14 |
| PLUM/PLUM/PLUM | 20 | 20 |
| BAR/BELL/BELL | 18 | 18 |
| BELL/BELL/BAR | 18 | 18 |
| BELL/BELL/BELL | 20 | 20 |
| BAR/BAR/BAR | 50 | 50 |
| 7/7/7 | 100 | 10,548 |
| WAGER AMOUNT | 1 | 2 |

1220

1230

FIG. 12

GAMING DEVICE AND METHOD OF OPERATION THEREOF

FIELD OF THE INVENTION

This invention relates to slot machines and, more specifically, to slot machines which are customizable by the player.

BACKGROUND

One of the main goals of a casino is to keep its customers playing as long as possible, since longer play generates higher revenues. Casinos are thus interested in maintaining player interest and excitement, especially with regard to slot machine play, which encompasses a large portion of the casino's revenues and profits.

There are several ways in which casinos currently attempt to maintain player interest in slot machines. One of these ways is the provision of various slot machines that pay out different prizes or jackpots. If a player is tired of playing for the $10,000 jackpot with low odds of winning, he or she can go to another slot machine that has a smaller payout but better odds of winning. The disadvantage of this is that the player must leave one machine and walk across the casino floor in search of another. The casino is not generating any revenue from that player while he or she are searching for a new machine having the desired payout. There is also the risk that the patron may get distracted during the walking time and never make it to another slot machine, or find some other game which does not provide as high a return to the casino. Players may also not find a convenient unoccupied slot machine with a desired payout and leave the casino in search of another machine in another casino. They can also simply change their minds, and decide not to play the slots anymore.

Another way casinos currently attempt to keep player interest is to have slot machines with a menu of available games from which the player can choose. While this may provide some variety to a novice player, the choices are limited and will not keep the interest of a regular casino patron for long, since he or she will eventually become familiar with the games.

One video poker game allows for altered payout tables because each card is drawn from an independent deck. U.S. Pat. No. 5,511,784 to Furry ("Method And Apparatus For Directly Generating A Random Final Outcome Of A Game") describes a system which modifies odds and potential payout between games based on the most recent games played. Furry also suggests that it may be preferable to modify the odds to make it harder to obtain a larger payout immediately after a large payout has been issued. This can be done without modifying any tables within memory and is also done by the gaming device without direct player input.

People generally are more likely to be interested in something over which they have some say or control. They are more likely, on the other hand, to get easily frustrated, or bored, with something that they perceive to be determined purely by chance or luck, pre-defined, or in some other way completely out of their influence. Many players are also frustrated after losing for many spins in a row. They would love to improve their odds of winning but have no way of doing so. Players on a "hot streak", on the other hand, sometimes believe that they are almost certain to hit a jackpot soon. The only way to get higher payouts is to move to a different machine, but this means abandoning the "lucky" machine.

There is, therefore, a need for a slot machine that induces the player to continue playing for extended periods of time.

SUMMARY OF THE INVENTION

In accordance with the present invention, a gaming device such as a slot machine provides a player the ability to modify at least one parameter of the slot machine. The slot machine then modifies other parameters to ensure a desired house advantage. In one embodiment, the slot machine allows the player to customize odds, payout schedules, or wager amount by trading off one variable for another to maintain a constant house advantage.

In a further embodiment, in order to compensate for a higher or lower payout chosen by the player, a gaming device alters the probability of attaining certain payouts, the amounts of payouts not customized by the player, or the amount of coins required per pull (wager amount), while keeping the house advantage constant. In one embodiment, gaming device software implements an equation that takes into account pertinent parameters or variables such as size of jackpot, amount of payment taken in at each pull, and probability of hitting the jackpot at each pull. Based on the equation, the software adjusts parameters other than the one(s) specified by the player so that the house advantage would remain constant with each pull. If, for example, the "house" decided that for every $1.00 wagered the machine was to give out $0.87, that payout ratio would remain true no matter what the choices made by the player were and the casino would not need to worry about increasing or decreasing the payout ratio. The player could also be given the ability to customize combinations needed for the smaller prizes. For instance, a player could specify that cherry—cherry—cherry will pay out 50 coins, not 30, or the player could specify how many times the combination with the low payout comes up.

In one embodiment, a touch screen provides an easy to use method of modifying selected parameters. This enables the player to control the slot machine and reconfigure it to provide desired characteristics. By providing players this control, they are less likely to leave a machine in search of a different machine having the characteristics desired. This in turn may prevent them from moving to a different casino, thus optimizing the overall return of the casino.

DESCRIPTION OF THE FIGURES

FIG. 10 is a table representative of customized payouts and the corresponding compensating payouts.

FIGS. 11A and 11B are tabular representations of customized payouts and the corresponding compensating probabilities.

FIG. 12 is a tabular representation of customized payouts and the corresponding compensating wager amount.

DETAILED DESCRIPTION

In the following description, reference is made to the accompanying drawings which form a part hereof, and in which is shown by way of illustration, specific embodiments in which the invention may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

An architecture for a customizable slot machine is first described, followed by a description of several different embodiments of the slot machine. Several payout tables are referenced. Various equations showing how parameters may be adjusted in accordance with the present invention, once a player modifies other parameters, are also referenced. Like components in the figures are commonly represented by the same reference number which should be clear from the context of use. Further, the reference numbers generally follow a convention wherein the hundreds and thousands digits correspond to the figure number in which the reference number first appears.

As used herein, the term "slot machine" means gaming machines including slot machines, video poker, keno, bingo, video roulette, and video blackjack machines wherein a paid play generates a random or pseudo-random outcome used to determine a payout.

Figure 1:
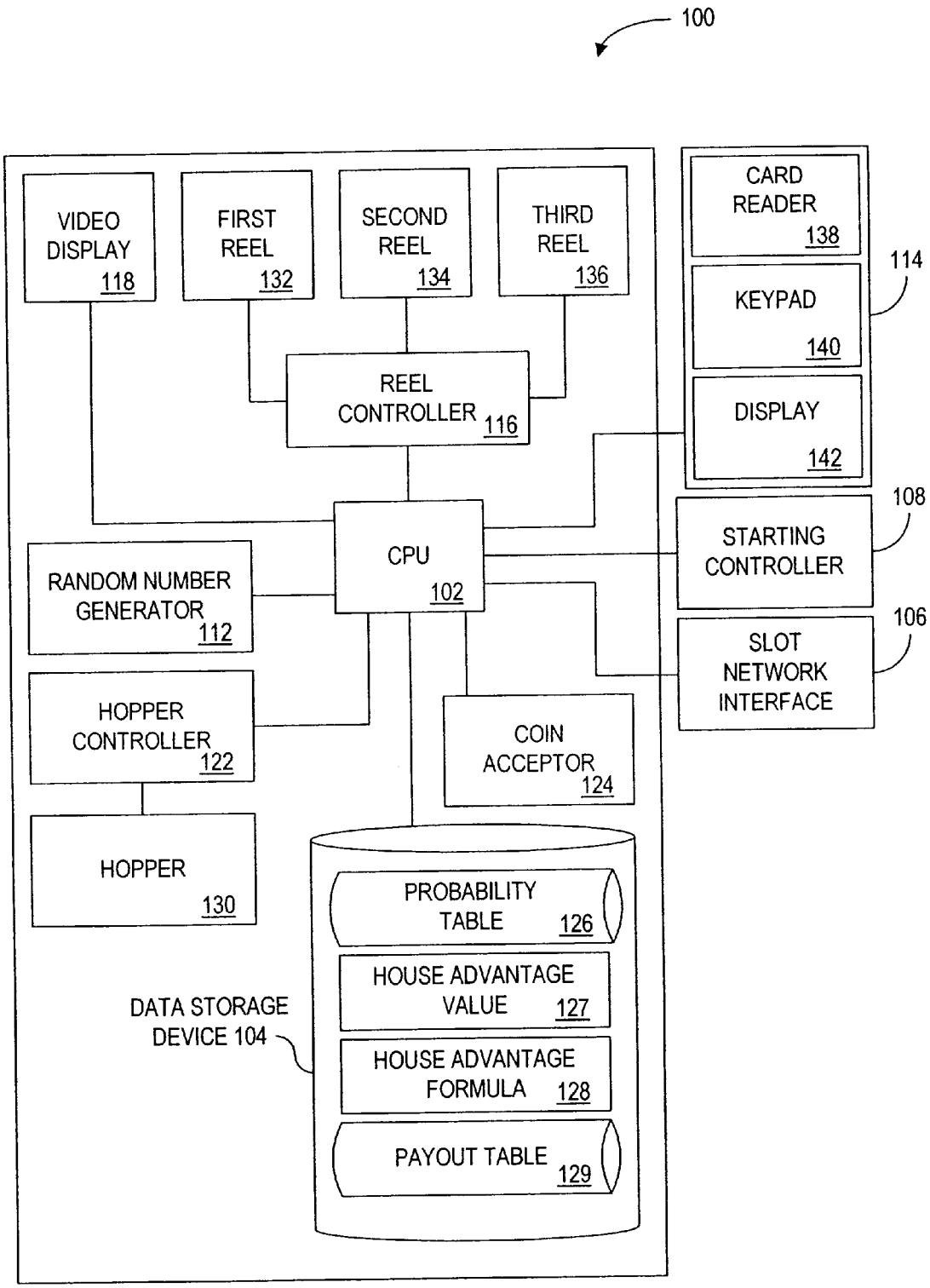
FIG. 1 is a block diagram of an architecture of a programmable slot machine.

A block diagram of a slot machine indicated generally at 100 in FIG. 1 comprises a central processing unit (CPU) 102 and a data storage device 104 in communication with the CPU 102. Further connected to CPU 102 are: a slot network interface 106, a starting controller 108, a random number generator 112, an input/output (I/O) device 114, a reel controller 116, a video display 118, a hopper controller 122, and a coin acceptor 124.

Referring again to CPU 102, the device comprises one of many well known processing units, for example a Pentium class CPU manufactured by Intel Corp. Data storage device 104 comprises an appropriate combination of magnetic and optical memory, such as disk drive memory, and semiconductor memory such as random access memory (RAM) and read only memory (ROM). Data storage device 104 stores a probability table 126, a house advantage value 127, a house advantage formula 128 and a payout table 129 as well as appropriate operating system and control software (not shown), functional to operate slot machine 100 in the manner described below. Random number generator 112 comprises one of many well known random or pseudo-random number generators suitable for use in a gaming device. As will be further described below, during game play, data storage device 104 also stores a player credit balance.

Coin acceptor 124 is operative to receive one or more coins, and to transmit an appropriate value signal to CPU 102. Hopper controller 122, and hopper 130 connected thereto, are operative under the control of CPU 102 to dispense coins to a player. Reel controller 116 is operative to control the spin and outcome displayed by first, second, and third reels 132, 134, 136, respectively, which may be mechanical in nature, or graphical and displayed on video display 118. Different numbers of reels may be used, or selected for use in further embodiments. In the present embodiment, slot machine 100 comprises a "22 stop" machine, such that 22 indicia are contained on each of reels 132, 134, 136. Video display 118 comprises any appropriate video display apparatus, for example, a touchscreen, a cathode ray tube or a liquid crystal display screen.

Starting controller 108 comprises a player-operated device such as a handle or button for initiating the play of a game. I/O device 114 comprises a conventional player interface including a card reader 138 for receiving a player tracking card, a display 142 for communicating alpha/numeric messages to the player, and a keypad 140 for receiving player input such as a player identifier.

Slot network interface 106 comprises a conventional network interface for connecting slot machine 100 to a centrally controlled network, thereby facilitating remote loading of new programs and values into data storage device 104 as desired.

Figure 2:
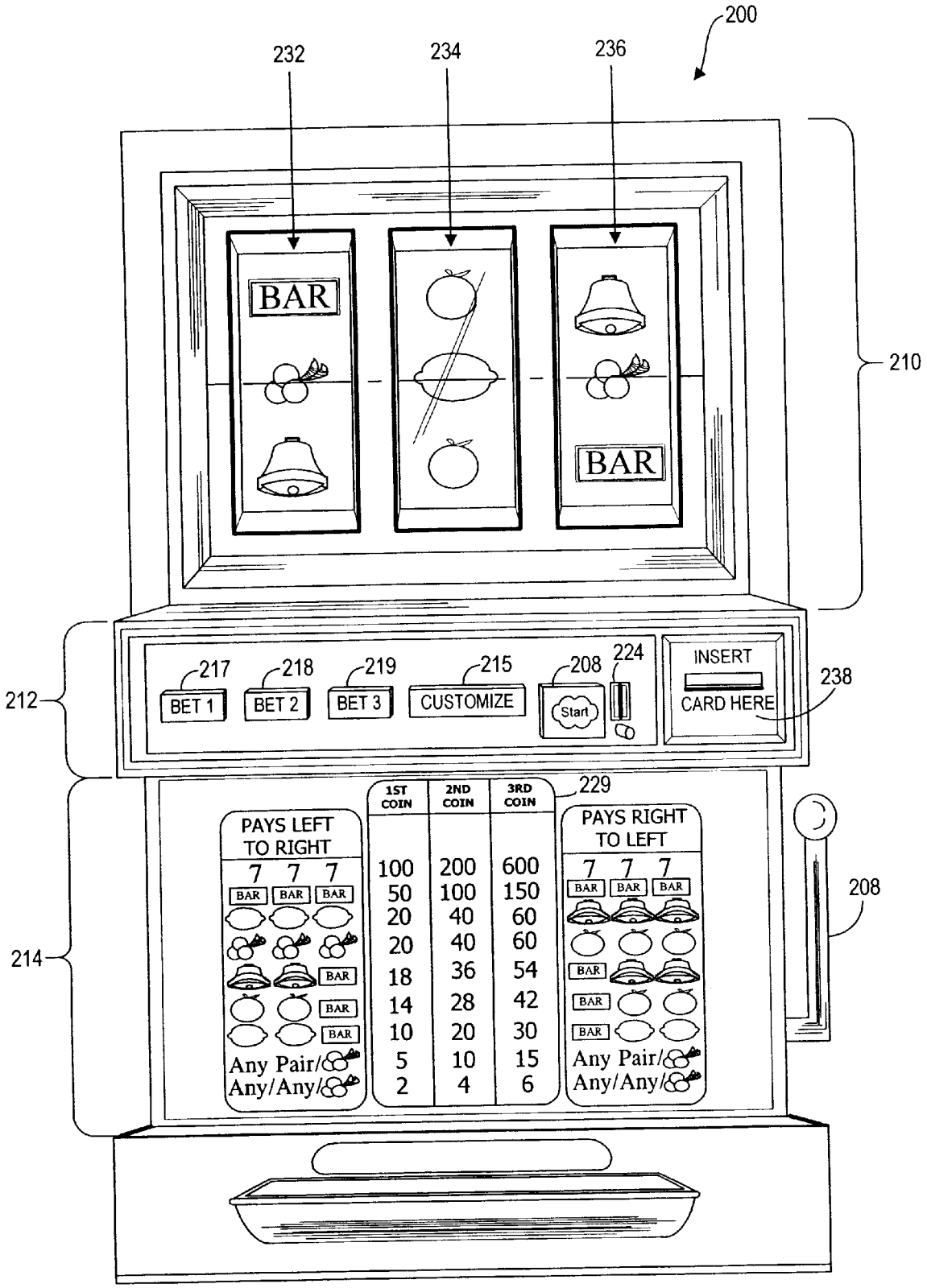
FIG. 2 is a front elevation view of the slot machine of FIG. 1.

A front elevation view of a typical slot machine is shown as indicated generally at 200 in FIG. 2. It should be noted that the arrangement of player interfaces may be varied significantly and still remain within the scope of the present invention. Slot machine 200 is generally divided into three sections: an upper panel 210, a central panel 212, and a lower panel 214. Upper panel 210 provides display of a first reel 232, a second reel 234 and a third reel 236 which, as previously mentioned with respect to the reel representations in FIG. 1, can be mechanical based or electronic in nature. In this embodiment, it is a conventional electronic graphical display capable of displaying computer generated data, such as a VGA monitor or LCD display. Central panel 212 comprises a card reader 238, a coin acceptor 224, a starting controller 208, various bet buttons 217, 218 and 219, and a customization button 215, which initiates display of a customization menu which will be described further below. The starting controller 208 may be, for example, a handle or a button. Lower panel 214 comprises a display of a pay schedule 229 comprising, for example, painted 'belly' glass. The details of pay schedule 229 are discussed below, and will change with customization by the player. Basically, the pay schedule describes the amount paid for the reel combinations shown, based on the number of coins or credits wagered. When a player actuates the customize button 215, which may be a mechanical button that is pushed, a capacitive switch, a touch screen button, or any other number of devices which sense a player selection, upper panel 210 provides display of a main customization menu as indicated at 310 in FIG. 3. The elements displayed in menu 310 comprise three selections, a payout selection 312, a probability selection 314 and a wager amount selection 316. These selection elements comprise a predefined area on a touch screen allowing a player to touch the area in order to invoke function to allow user customization of parameters associated with each selection. The customization menu may also be presented on a VGA monitor and the player selections signaled by a cursor associated with well known cursor control devices, such as a touchpad, trackball, or mouse.

Figure 4A:
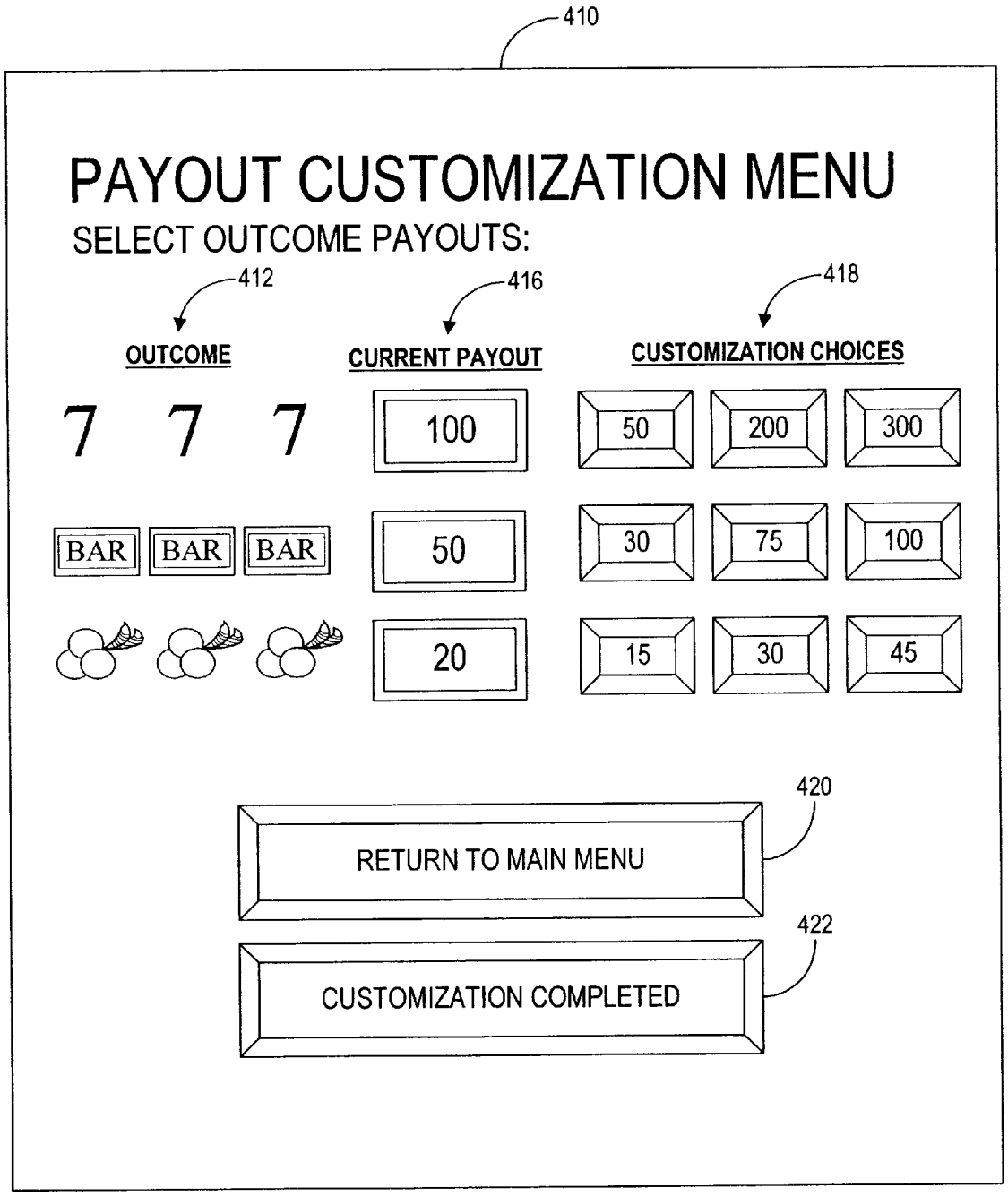
FIG. 4A is an illustration of a payout customization menu screen for the slot machine of FIG. 1.

FIG. 4A illustrates a payout customization menu 410 which is displayed upon selection of payout selection 312. Menu 410 comprises an outcome display 412 comprising sample representations of three potential winning outcomes such as three "7s", three bars and three cherries. Current payout displays 416 show corresponding current payouts for the winning outcomes. The values shown in current payouts diplays of FIG. 4A are the default payouts (i.e. before customization begins) of "100", "50" and "20". As the player customizes the payouts, his selection(s) will replace the values shown in the "current payouts" displays 416. This process will be further illustrated in FIGS. 5 and 6. Customization choices displays 418 show alternative payouts which may be selected by a player as by touch screen or other selection device. Further selections comprise a "Return to Main Menu" button 420, which brings up the previous menu allowing customization of another parameter, and a "Customization Completed" button 422 which, when selected, causes the slot machine to adjust other parameters which were not selected in order to maintain a desired house advantage. The adjustment of other parameters is described further below following a description of the player interfaces. The outcomes available for customization, as illustrated in FIG. 4A, are meant as examples only. Any number and variety of outcomes could be available to the player for customization.

Figure 4B:
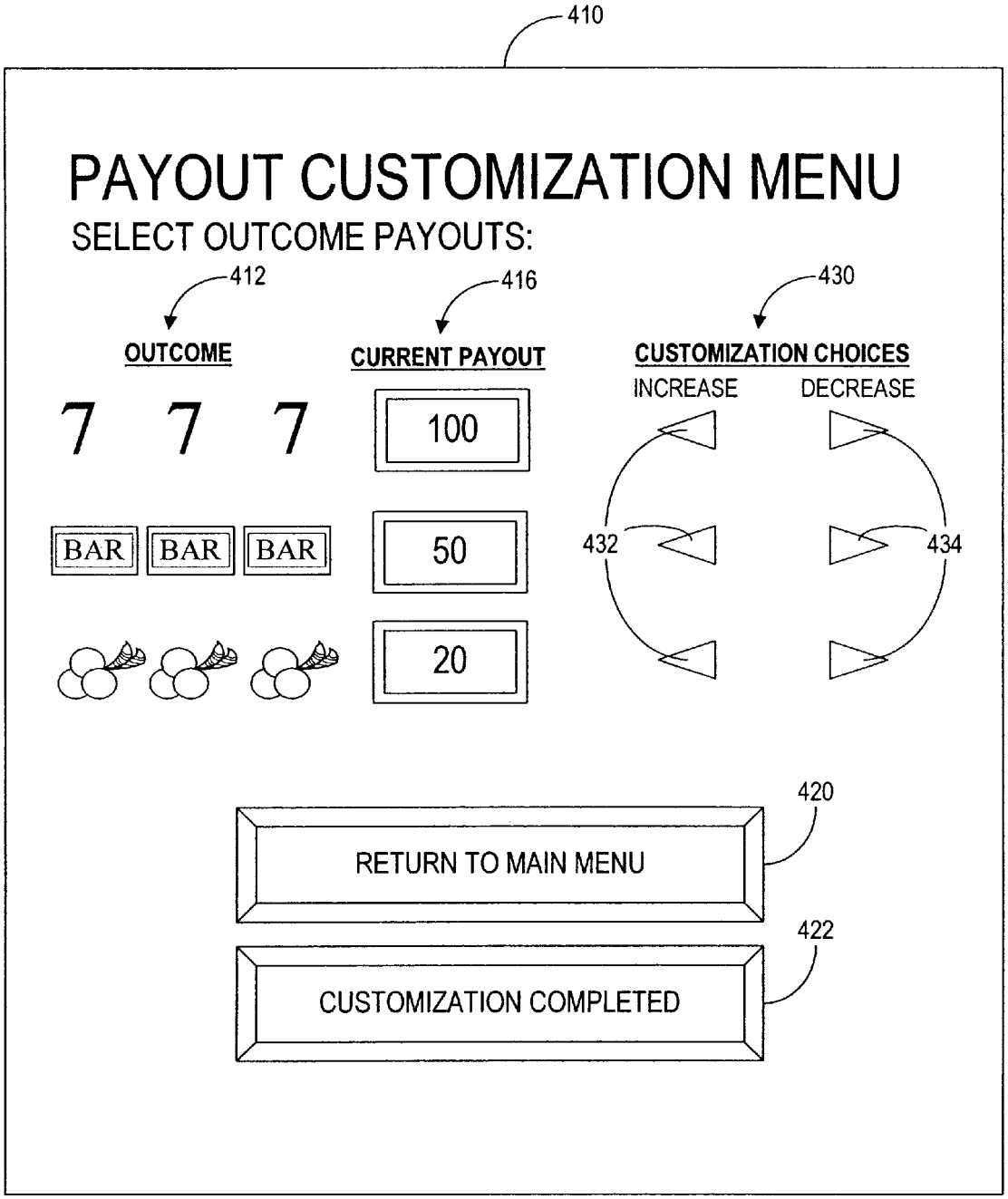
FIG. 4B is an illustration of an alternative payout customization menu screen for the slot machine of FIG. 1.

FIG. 4B shows a variation of the customization menu 410 wherein a new customization choices display element 430 contains "Increase" and "Decrease" buttons 432 and 434. These buttons allow a user to incrementally increase or decrease payouts for each corresponding outcome without being limited to selecting from predetermined values. In this embodiment, as the player presses the "Increase" and/or "Decrease" buttons, the corresponding "current payout" value changes accordingly. For example, if the player presses the "Increase" button corresponding to the "7—7—7" outcome once, the current payout value for that outcome would change from "100" to "101."

Figure 5:
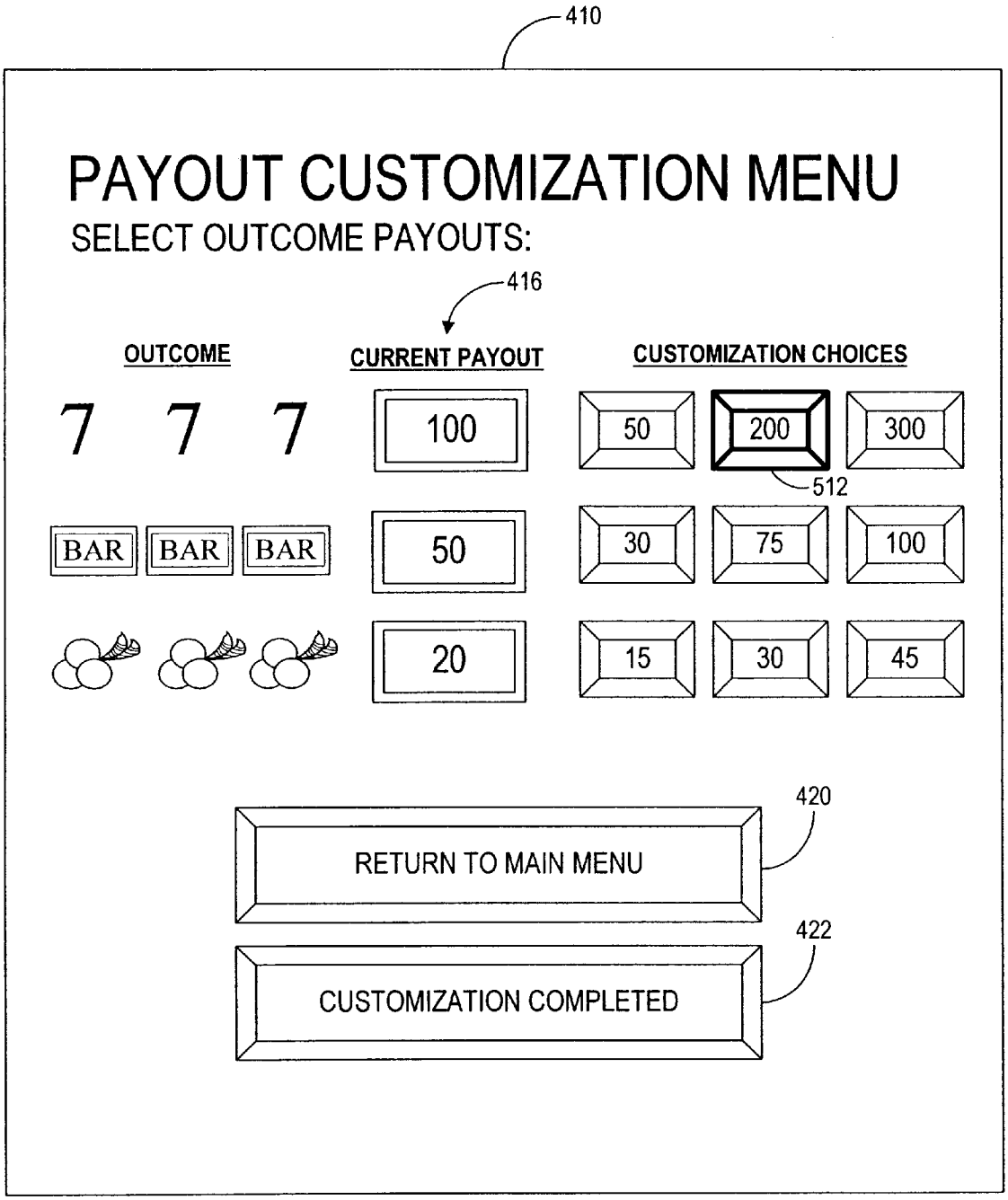
FIG. 5 is an illustration of a specific payout customization menu screen for the slot machine of FIG. 1.

Returning now to the embodiment first illustrated in FIG. 4A, FIG. 5 shows the customization choices of the player. For an outcome of "7—7—7", the player has chosen "200" at 512 as opposed to the default payout of "100". For the outcomes Bar, Bar, Bar, and Cherry, Cherry Cherry the player has left the default values of "50" and "20" respectively, as indicated at 416. The player has thus obtained a feeling of control and is more likely to stay with the current machine. Upon selection of the customization completed button 422, the current payout displays 416 change. The customized payout selection of "200" corresponding to the outcome "7—7—7" is displayed at 612. The machine calculated value of "15" corresponding to the outcome Cherry, Cherry, Cherry is displayed at 616. The payout associated with the outcome Cherry, Cherry, Cherry has been decreased to compensate for the increase in the "7—7—7" payout to ensure that the house advantage remains constant.

In a further embodiment, menus similar to menu 410 may be provided for selection of other parameters. For example, by substituting "current probabilities" for the "current payout" of display 416, and selecting probabilities in the customization choices 418 display, the menu represented in FIG. 4A is easily changed to handle customization of probabilities. To change the wager amount, only two display areas are required, such as represented at 416 and 418 since the wager amounts pertain to all outcomes. Hence the display area 416 would represent the current wager amount, and display area 418 represents the choices as determined by the casino. In an alternate embodiment, the wager amount button on main menu 310 represents multiple amounts which may be selected directly from the main customization menu 310 without having to navigate to a secondary menu. In a still further embodiment, rather than selecting from predetermined choices, a player may enter a desired amount either via a keypad, or by selecting up and down arrows 432 and 434 displayed on the payout customization menu 410 as shown in FIG. 4B. Such selection will cause display of a customized payout value which may then be selected by pressing button 420 or 422. Further buttons may be provided to cancel customization at any point in the process of operating the menu.

There are many examples of player customization. In one example, a player chooses to double the top jackpot. The slot machine compensates by lowering the odds of hitting the top jackpot in order to maintain a pre-defined house advantage of 7% or other desired percentage. In another example, the player may choose to increase the odds of hitting a jackpot and decrease the wager per pull. The slot machine compensates by decreasing the value of the jackpot payout. Alternatively, the player may choose to increase the value of smaller prizes. In this case, the slot machine compensates by lowering the odds of hitting combinations that yield those prizes. The above-described menus that allow customization are provided by software, referred to as a player input module. The player input module receives a modification to one or more game parameters through menus and player interaction with the slot machine. The software is stored in storage device 104.

Figure 7:
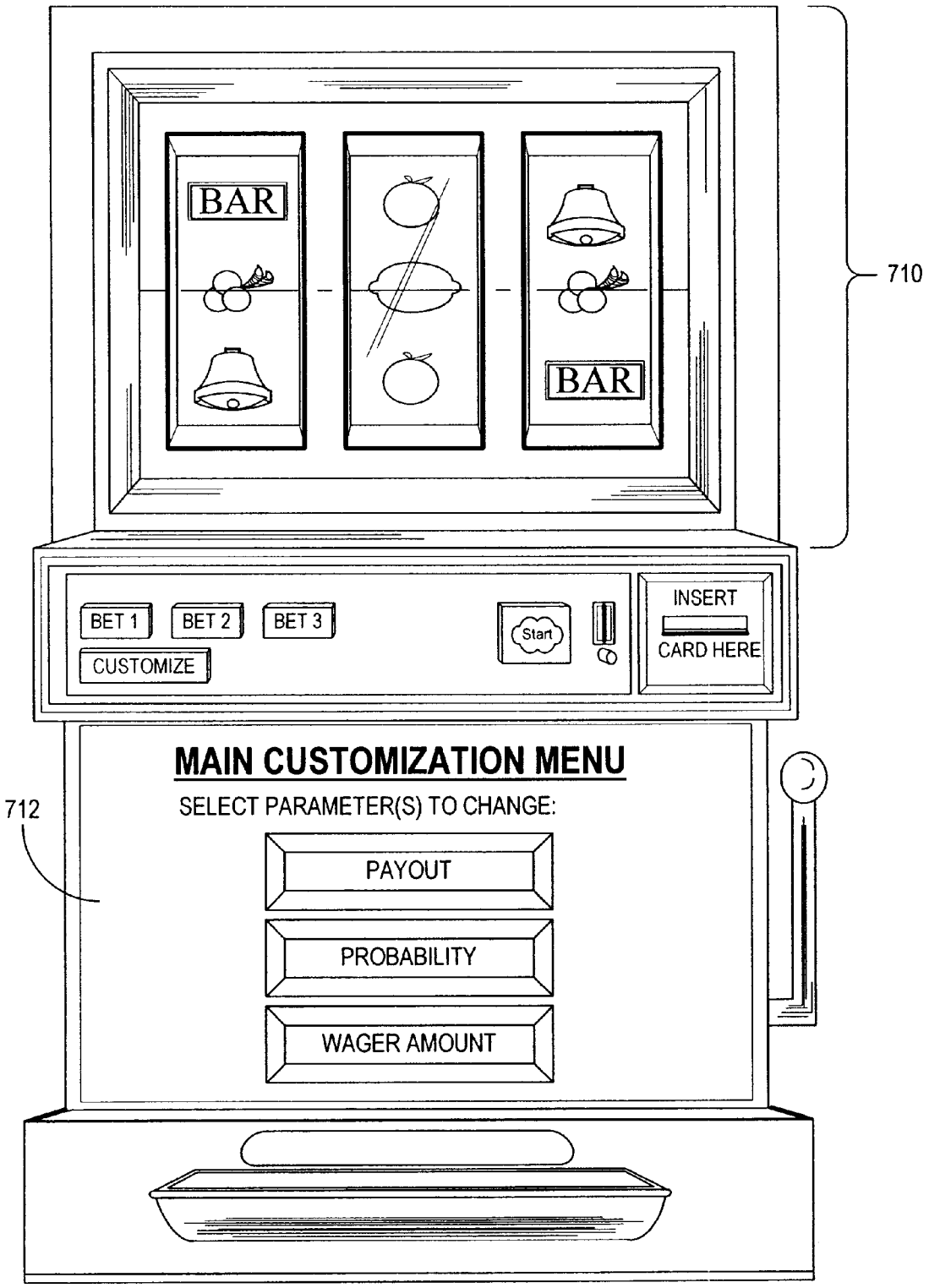
FIG. 7 is a front elevation view of an alternate embodiment of a slot machine having a screen display appear in place of the payout schedule.
Figure 8:
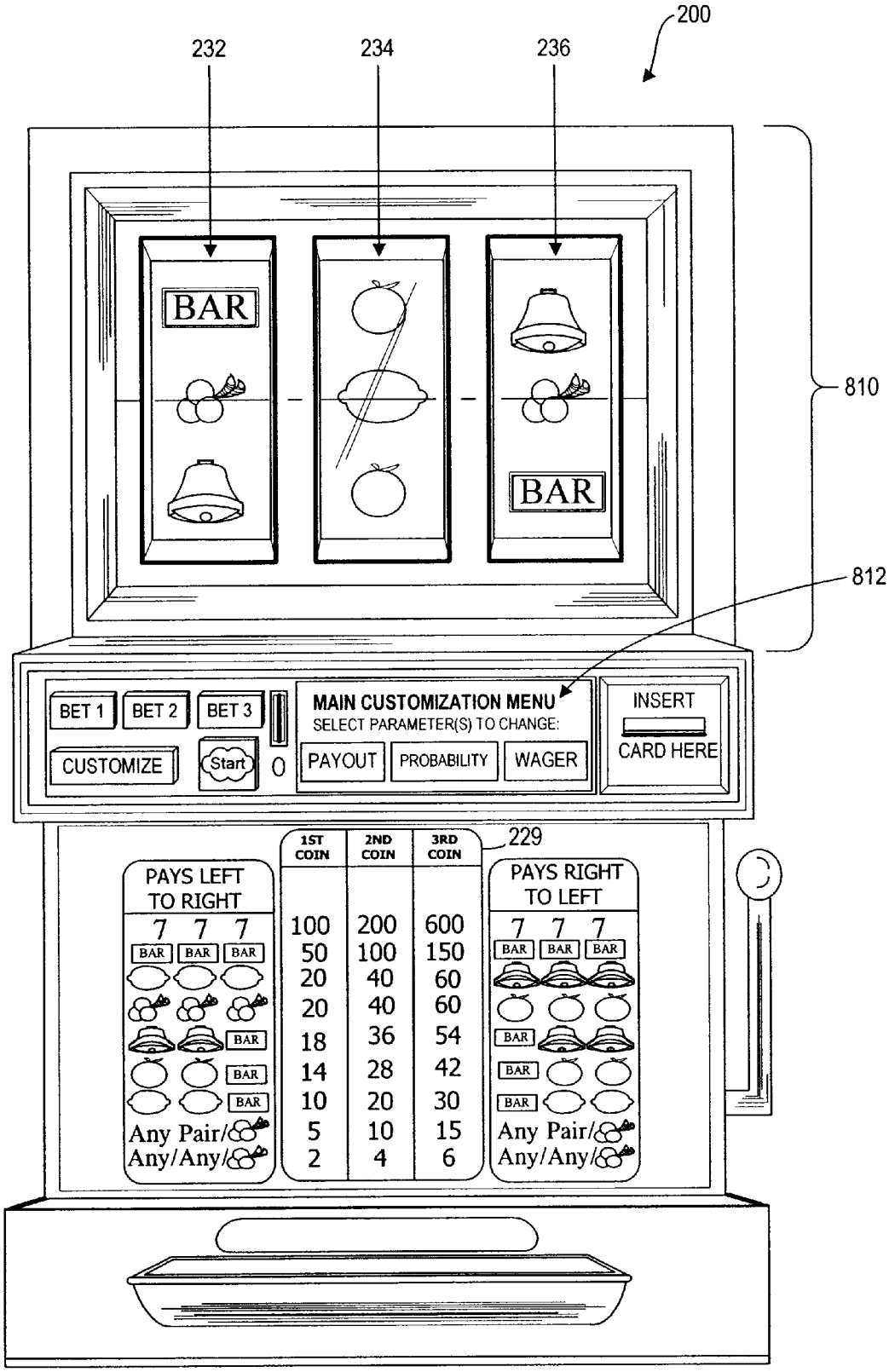
FIG. 8 is a front elevation view of an alternate embodiment of a slot machine having a screen display built into the middle part of the body of the machine.

In FIG. 7, an alternate embodiment of a slot machine 710 includes screen display 712, which comprises a main customization menu in the lower portion of the slot machine. In this embodiment, the display 712 is electronic and shows the payout schedule when a player is not in the process of customization. FIG. 8 is an illustration of an alternate embodiment of a slot machine 810 where a main customization menu 812 is built into the middle part of the body of the machine.

Figure 9A:
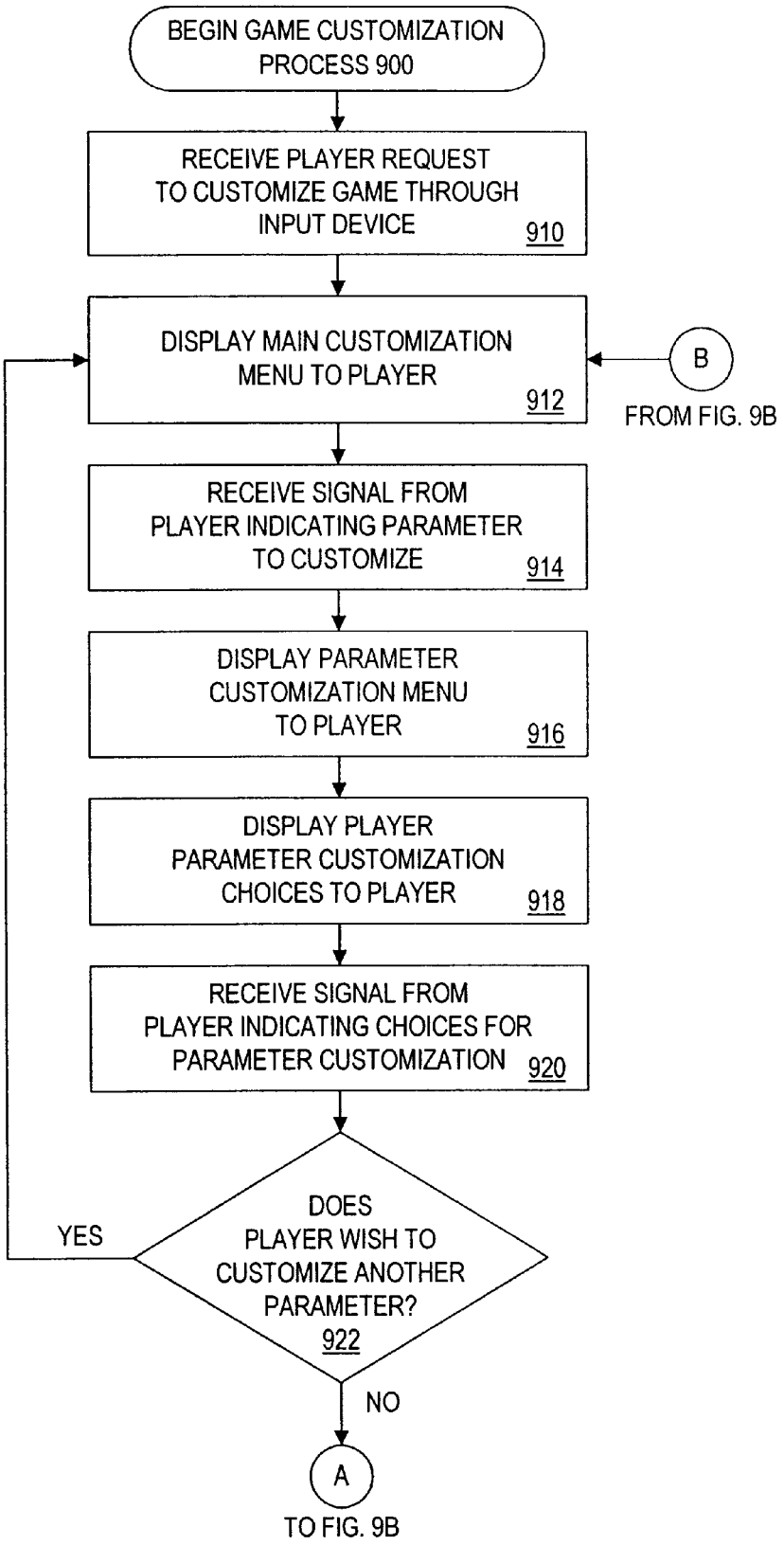
FIGS. 9A and 9B together comprise a flowchart representation of a customization step for a slot machine.
Figure 9B:
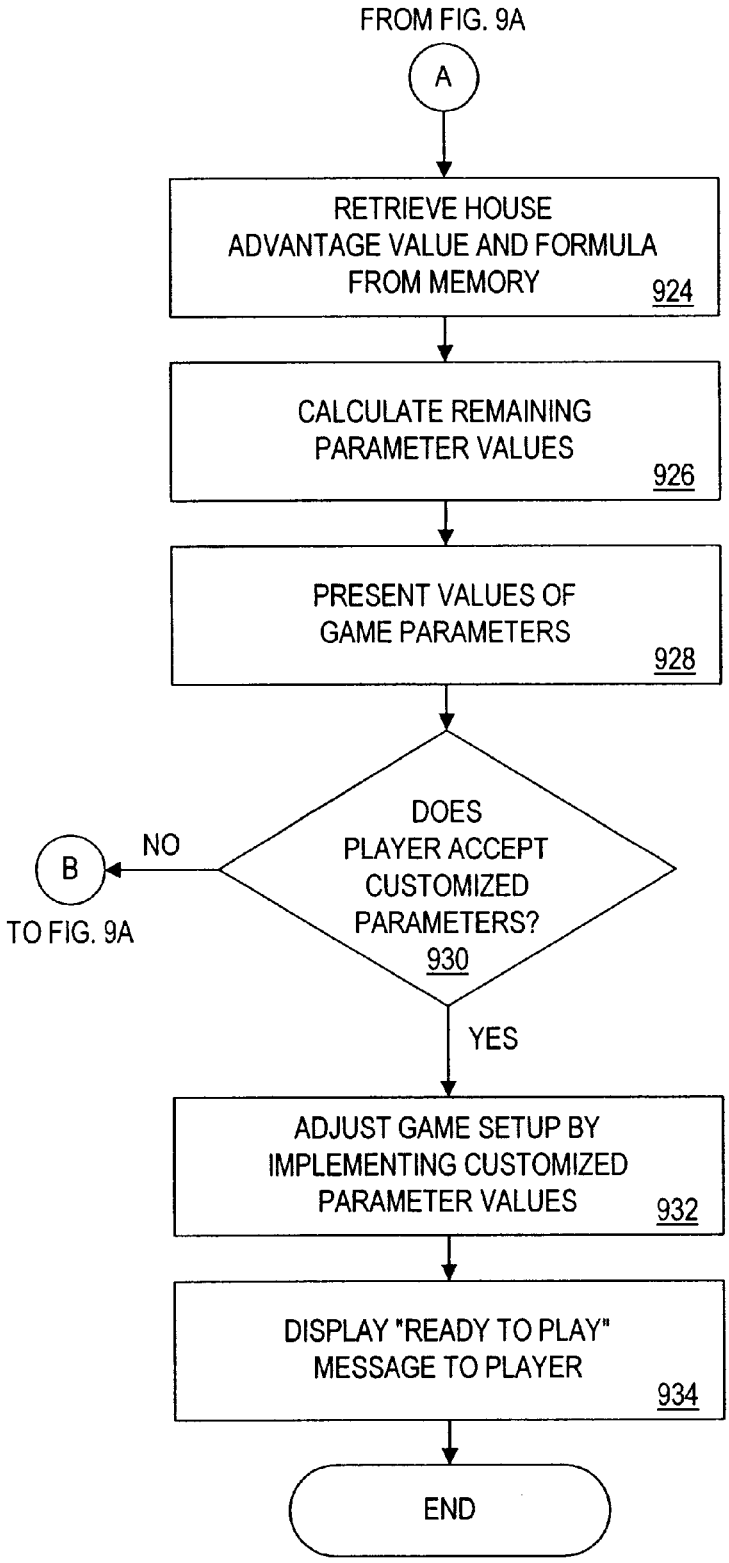

FIGS. 9A and 9B together comprise a flowchart of the customization process. In one embodiment, the flowchart represents the steps carried out by CPU 102 while executing a program, including a parameter modification module and the player input module stored on data storage device 104. The program may be stored on any machine readable medium and may be downloaded from a remote device via network interface 106 which may comprise an ethernet card, modem or other suitable communications card or port. The customization process begins at 900 and is represented by blocks in flowchart form. The blocks represent steps performed by software modules or objects.

Figure 3:
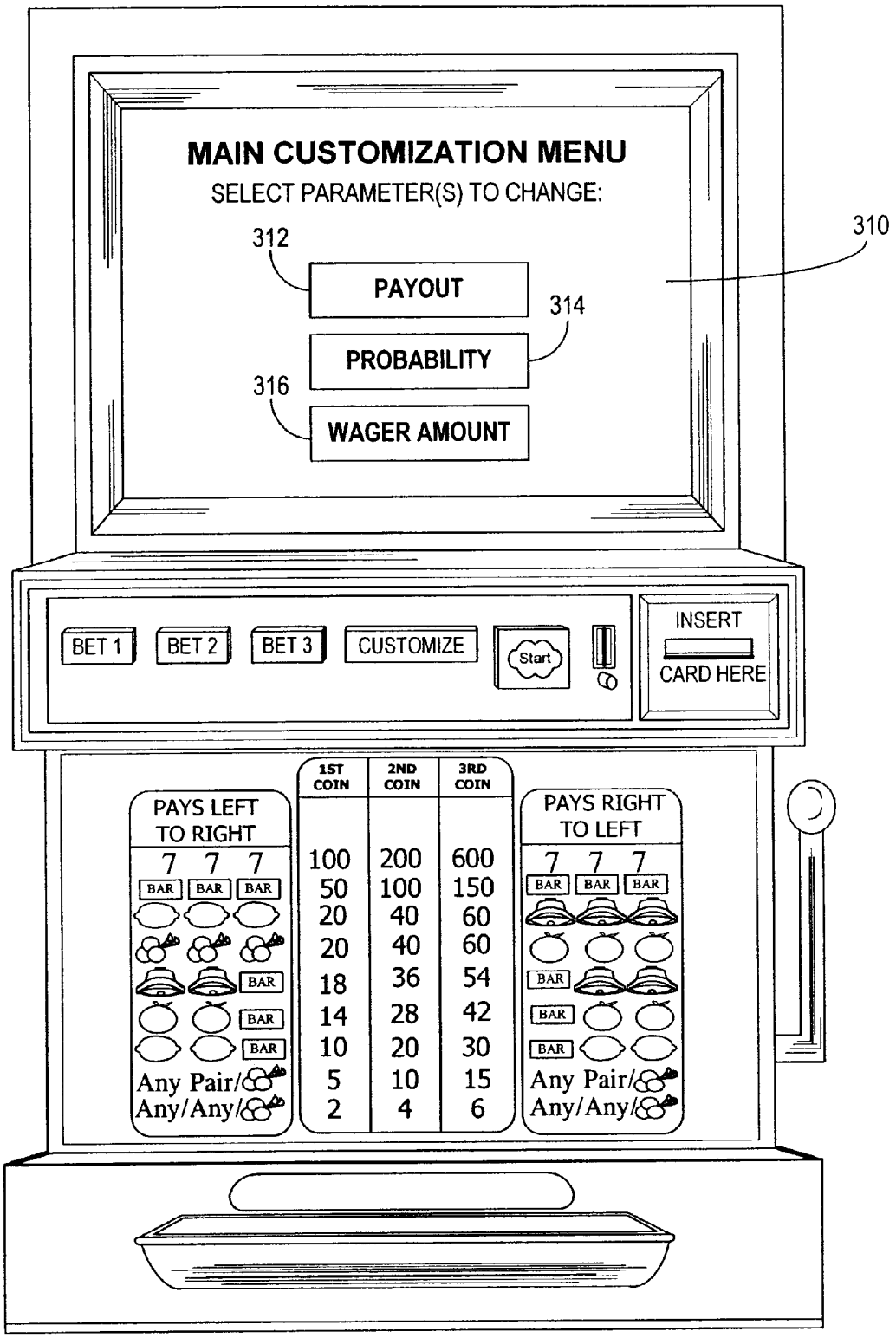
FIG. 3 is a front elevation view of the slot machine of FIG. 1 showing a menu operable for customization.
Figure 6:
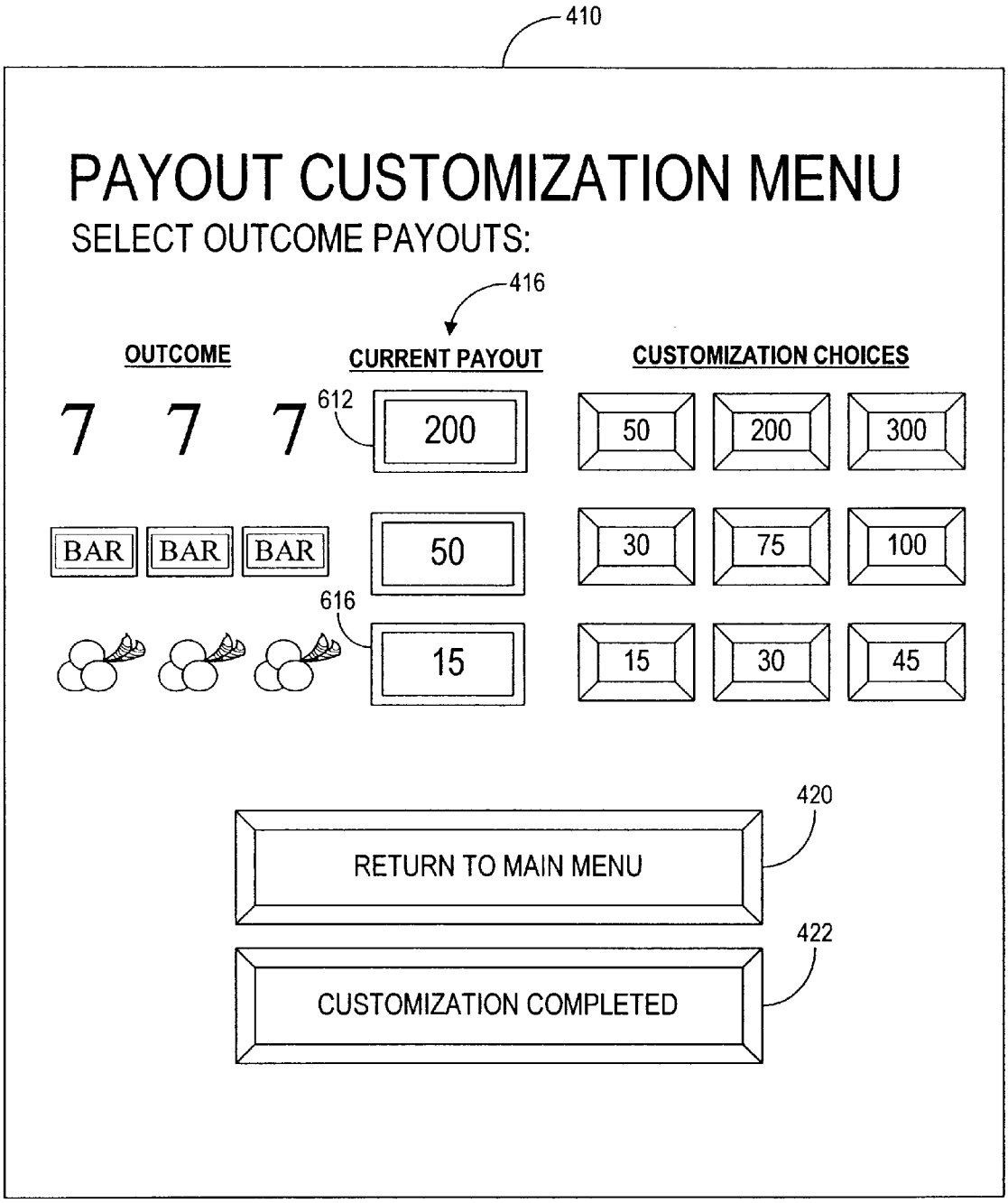
FIG. 6 is an illustration of adjusted 'current payout' output based on the player's choices in FIG. 5.

A player request to customize a game is received at step 910 and the main customization menu is displayed at step 912. The customization step 912 is illustrated in FIG. 3 as "MAIN CUSTOMIZATION MENU" 310. At 914, a signal from a player, indicating a parameter to customize, is received. At 916, the customization menu of the selected parameter is displayed to the player. At 918, parameter customization choices are generated and displayed to the player. The customization steps 916 and 918 are illustrated for the payout parameter in FIG. 4A as menu 410. Similar menus may be generated for other parameters. The customization choices may be preprogrammed and stored in a table, or may be generated by the casino at a central server and downloaded into storage device 104 for use by this process. Alternatively, the player may chose any value between a selected range for parameters, as illustrated for the payout parameter in FIG. 4B. At 920, a choice for parameter customization in FIG. 5, is received from the player. The customization step 920 is illustrated for the payout parameter in FIG. 5 at 512. At 922, if the player wishes to customize another parameter flow is returned to 912 where the main customization menu is once again displayed to the player. The customization step 922 is illustrated in FIG. 5 at 420 and 422. If no further customization requests are indicated by the player, recalculation of other parameters occurs. At 924, a house advantage value and formula are retrieved from memory 104, and at 926, remaining parameter values are calculated. At 928, the resulting parameter values (player selected and machine recalculated) are used to replace the default values and are displayed to the player at 928 as indicated at elements 612 and 616. The recalculation of internal parameters is a process executed within the machine and, therefore, is not shown in the Figures. The customization step 928 is illustrated in FIG. 6 at 612 and 616.

Next, the program checks at 930 to see if the player has accepted the customized parameters. A player can so indicate by pressing the customization completed button 422 or the return to main menu button 420. If the player has not accepted the customized parameters, control is returned to block 912 to display the main customization menu and offer the player a chance to change the customization or return to default values. In one embodiment, a timer is used to automatically reset the slot machine to the default values if no activity is detected for a predetermined time. Once the player has accepted the customized parameters at 930, a game setup is modified by implementing the customized parameter values in a known manner at block 932. A "Ready to Play" or other suitable indication is provided to the player at 934. Internal customization tables are changed, and the game may then be played and the customization process ends at 940.

These steps apply equally well to the customization of parameters other than payout. Such parameters are easily modifiable by following the above steps. In particular, at 912, the player is shown the parameters available for customization. At steps 914 to 916, the player selects at least one parameter to be customized. At step 920, the player selects at least one value to substitute for the default values, and at step 926, the machine adjusts other parameter values or a value to compensate for the player selected values. The resulting values are displayed at 928, and the player accepts or rejects the resulting set at 930. Finally, the machine applies the accepted values to game play at 932.

Parameter Customization Operation

Multiple formulas may be stored within data storage device 104 and used by the above process to enable the CPU to calculate how much one or more parameters must change in order to accommodate the parameter customization by the player, while keeping the house advantage constant. The most basic equation (1) provides the relationship between the wager amount, payouts, probabilities, and the house advantage:

$$WagerAmount - \sum_{i=1}^{n} \left(Prob_{x_i} \times Pay_{x_i}\right) = HouseAdvantage \tag{1}$$

Where n is the number of possible outcomes $x_i$ is the ith outcome $Prob_{x_i}$ is the probability of the ith outcome occurring $Pay_{x_i}$ is the payout associated with the ith outcome Wager Amount is the number of coins wagered House Advantage is the portion of the wager retained by the casino In other words, the house advantage is equal to the wager amount less the sum of all potential payouts times the probability of each potential payout. This sum of all potential payouts multiplied by their respective probabilities is known as the expected value of the payouts. After altering one of the parameters and selecting another "compensating" parameter to change as a result, the above equation enables the slot machine 100 to determine how much the compensating parameter must change.

Although the above equation is sufficient to calculate any required changes, it requires that a compensating parameter be selected. By establishing rules for the selection of the compensating parameter change, the above equation may be simplified. For example, if it is assumed that for every payout change requested the machine is to calculate a new probability associated with that payout, and that any probability changes are compensated by a change to the probability of getting no payout, the equation collapses to:

$$CompensatingProbability_{x_i} = \frac{\left(OldPay_{x_i} \times OldProb_{x_i}\right)}{NewPay_{x_i}} \tag{2}$$

Where

Compensating $Prob_{x_i}$ is the new probability generated to offset the payout change Old $Pay_{x_i}$ is the payout for $outcome_{x_i}$ before the player made the change Old $Prob_{x_i}$ is the probability for $outcome_{x_i}$ before the player made the change New $Pay_{x_i}$ is the new payout for the outcome selected by the player In another example, an equation can be generated to calculate a payout change to compensate for another payout change, assuming that the compensating payout is predetermined.

$$Pay_{c_{new}} = \frac{\left[\left(Prob_{c_{old}} \times Pay_{c_{old}}\right) - \left(Prob_{x_{i_{new}}} \times Pay_{x_{i_{new}}}\right) + \left(Prob_{x_{i_{old}}} \times Pay_{x_{i_{old}}}\right)\right]}{Prob_{c_{new}}} \tag{3}$$

Where c denotes the compensating parameter that the machine adjusts x denotes the parameter customized by the player In yet another example, an equation is developed to calculate a wager change to compensate for a payout change as follows:

$$NewWagerAm\ ount = OldWagerAm\ ount + (Pr\ ob_{x_{new}} \times Pay_{x_{new}}) - (Pr\ ob_{x_{old}} \times Pay_{x_{old}}) \tag{4}$$

Similar equations may of course be developed for other compensating requirements. In one embodiment, all parameters that are not modified by the player are modified to compensate for the player modified parameters. The above equations are examples only. It is understood that other equations may be developed by those skilled in the art. FIGS. 10–12 illustrate the use of some of the above equations. In all of the above equations, it should be noted that there may be restrictions on the number of parameters that may be changed by the player, so that the slot machine has enough remaining parameters to accommodate the amount of compensation required.

FIG. 10 shows a table indicated generally at 1010 of payouts having multiple columns comprising an outcome column 1012, a default payout column 1014 and a customized payout column 1016. There are 18 records or rows corresponding to payouts for each of 18 outcomes. Columns 1014 and 1016 indicate the number of coins paid out on a game play where a random number results in the generation of a particular combination shown in outcome column 1012. More particularly, the payout columns indicate the number of coins paid out on a game play where a random number results in the generation of a particular combination or outcome 1012. This table shows customized payouts where the player adjusted the payout of the top jackpot from 100 to 200 coins in a row 1020 and the machine automatically adjusted the cherry—cherry—cherry payout from 20 to 15 coins in row 1022, using equation 3 above. The customized and compensating payouts of FIG. 10 correspond to those of the customization process illustrated in FIGS. 4A, 5, and 6. A payout other than cherry—cherry—cherry could have been designated as the compensating payout if desired. Such selections are more easily programmed in by the house, but, in an alternate embodiment, could be selected by the player. The important aspect of the compensating payout is that it is determined such that a constant house advantage is maintained (5.5% in this example).

FIGS. 11A and 11B are a payout table 1100 and a probability table 1120 which illustrate another embodiment of the current invention. In this embodiment, the slot machine 100 adjusts the probabilities of hitting the prize-winning outcomes corresponding to the player customized payouts, using equation 2. Payout table 1100 comprises an outcome column 1112, a default payout column 1114 and a customized payout column 1116 as in FIG. 10. Probability table 1120 comprises an outcome column 1122, default random number column 1124 and expected hits per cycle column 1126, and two corresponding customization columns comprising random number column 1128 and expected hits per cycle column 1130. Specifically, FIG. 11A shows the player's payout customization choices (for 7—7—7, bar—bar—bar, and plum—plum—plum corresponding to rows 1117, 1118 and 1119) while FIG. 11B shows the corresponding probability changes made by the slot machine, determined by using formula 2 at rows 1137, 1138 and 1139 respectively. It should be noted that while the tables have been shown as two separate figures, they may actually be part of the same table, or further broken into smaller tables for programming efficiencies.

The above random number columns contain values which indicate a range of random numbers associated with each record, or outcome. For example row or record 1139 corresponding to plum—plum—plum comprises a default range of 10534 to 10583. Thus, when random number generator 112 generates a random number in the range of 10534 to 10583 for a game play, reel controller 116 controls reels 132, 134, 136 to display the described plum—plum—plum combination. Further, when customized, the range of 10568–10592 causes the same display to appear when a random number is generated in that range. As seen in the expected hits column, the values in the fields corresponding to those columns at that record show that a random number will fall in the customized range about half that of the default range. With a cycle of 10,648 plays, plum—plum—plum is expected to occur in the default range 50 times, and in the customized range of random numbers, 25 times.

FIG. 12 is a representation of another embodiment of the present invention. In this embodiment, slot machine 100 compensates for the player customization of the payout parameter by adjusting the wager amount, using equation 4. As with previously shown payout tables, payout table 1200 has an outcome column 1210, a default payout column 1212 and a customized payout column 1214. Allowing the player to customize the top jackpot by raising it from 100 coins to 10,548 coins at record 1220 raises the required wager amount from 1 coin to 2 coins at record 1230 with no change in the probability of hitting the 7—7—7 outcome.

Alternate embodiments

The following embodiments generally fit into the flow diagrams of FIGS. 9A and 9B. The steps in the diagrams represent the same steps used to implement each of the alternate embodiments described below.

In one embodiment, the player may pick how the jackpot will be awarded. Jackpots may be awarded as one lump sum, or as payments over a number of years. For example, a player could be given the option of customizing a top $1 million jackpot to be given out as one lump sum or in portions over a 10, 15 or 20 year period of time. Awarding jackpots as payments over a number of years allows the casino to collect interest on the money over those years and also effectively lowers the payout when the time value of money is taken into account.

The number of reels could also be allowed to be chosen by the player. This embodiment addresses the variability of the overall chances of hitting the jackpot. As the number of reels changes and the odds of each individual reel are maintained at a constant level, the overall odds of hitting the jackpot decrease (If the slot machine starts out with 4 reels, each having a 2/22 chance of coming up with a jackpot symbol, the resulting probability of hitting the top jackpot is 16/234,256. Adding one more reel, also with 2/22 odds, the results in a probability of hitting the jackpot of 32/5,153,632).

Casino reward points could also be allowed to be traded off for improved odds or higher jackpots. The machine could access the player's point balance based on an identifier read off of a player's card and deduct points from his account if he indicates that that is his preference on the pertinent menu. For example, some programs offer up to 0.5% cash back on all money wagered. The player could elect to forego this payback in exchange for increasing the probability of hitting the top jackpot.

Another customizable parameter could be the symbols on the reels where the reels are electronic in nature. The player may be allowed to choose how many of a certain symbol appear on a given reel or what symbols make up a winning outcome. In the case of altering the number of a given symbol on a given reel, the probabilities of hitting the outcomes with that symbol would have to be adjusted accordingly. In the case of choosing what symbols make up a winning outcome, the selected symbols would simply be substituted into the reels and the probability and payout tables accordingly. This may appeal to players that consider one particular symbol their "lucky" one (e.g. "my jackpots were always won with a lemon as one of the symbols so lemons are lucky for me.").

The player could customize the top jackpot to be the "paying off" of one of the player's credit card balances. The player would enter in his credit card account number before play begins and if he won the top jackpot the casino would pay the balance due on the credit card account as of the time of the win. There would be a limit as to how large the balance could be (e.g. the casino will pay any balance up to $10,000) and the house advantage for the machine would be determined under the assumption that all of the jackpot wins would be worth $10,000.

The machine could prompt the player with customization offers upon certain event triggers. After a series of losing spins, the machine might suggest that the player increase the probability of a winning outcome in exchange for lowering one or more payouts.

In a further embodiment, the player's preferences for customizing the slot machine could be stored on the slot server and retrieved by means of the player identifier when the player inserts a player-tracking card into a machine. The touch screen presented in the preferred embodiment could alternately be a computer screen accompanied by a keypad that allows the player to select and enter data.

Video Poker Alternate Embodiments

The player may add more cards to a deck, substitute extra cards for existing ones in a deck, or designate a wild card in a deck. For example, a player may choose to add two more Jacks of spades to the conventional one in a deck, substitute an extra ace of diamonds for a two of clubs, and make all threes wild cards.

The player could alter the probability of getting a top payout after being dealt his initial five cards. For example, a player dealt four cards to a royal flush typically holds these four cards and draws one. Only one card in the 47 remaining cards will give the player the royal flush. In order to improve his odds, the player might be shown a representation of all of the remaining 47 cards and allowed to select one or more cards which will not be dealt. The player could thus eliminate the four of clubs, eight of diamonds, and six of spades, improving his chances of hitting the royal flush to one in 44. This change in probability is compensated by a decrease in the payout for the royal flush. Alternatively, the player could add cards to the 47 in exchange for a higher payout. Other video poker game parameters may also be modified based on the player modification to the deck of cards.

It is to be understood that the above embodiment descriptions are intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A gaming device comprising:

a player input module that receives a modification to a first game parameter from a player; and a parameter modification module that modifies a second game parameter based on the modification to the first game parameter to maintain a desired house advantage.

2. The gaming device of claim 1 wherein the desired house advantage is a predetermined constant.

3. The gaming device of claim 1 wherein the modification module modifies a third game parameter in conjunction with modifying the second game parameter.

4. The gaming device of claim 1 wherein the first game parameter comprises a desired payout amount.

5. The gaming device of claim 4 wherein the second game parameter is selected from the group consisting of the probability of a given outcome occurring, wager required to play, and other payouts.

6. The gaming device of claim 1 wherein the first game parameter is selected from the group consisting of payout, odds of winning the payout, number of cards in a deck, removal of cards from a deck, substitution of cards in a deck, number of reels and wager required to play.

7. The gaming device of claim 1 wherein the player input module enables a player to modify a plurality of game parameters.

8. The gaming device of claim 1 wherein the parameter modification module modifies a plurality of parameters not modified by the player.

9. The gaming device of claim 8 wherein all parameters not modified by the player are modified by the parameter modification module.

10. A method of operating a gaming machine comprising the steps of:

receiving a player input representative of a desired modification to a game parameter; and modifying another game parameter based on the desired modification and a desired house advantage.

11. The method of claim 10 and further comprising the step of displaying the modified game parameters to the player.

12. The method of claim 10 and further comprising the steps of:

executing a play of the gaming machine using the modified game parameters;

determining an outcome of the play; and determining a payout amount based on the outcome.

13. The method of claim 11 wherein the game parameters are selected from a group consisting of payout amount, wager amount, and odds of winning.

14. A machine readable medium having instructions stored thereon for causing a gaming machine to perform the steps comprising:

receiving a player input representative of a desired modification to a game parameter; and modifying another game parameter based on the desired modification and a house advantage.

15. A method of operating a gaming machine comprising the steps of:

receiving from a player a selected value for a first game parameter;

retrieving a house advantage value; and adjusting a second game parameter based on the selected value of the first game parameter and the retrieved house advantage value to ensure that the relationship between amounts wagered and payouts remains substantially constant over time.

16. A method of operating a gaming machine comprising the steps of:

receiving from a player a selected value for a first game parameter;

retrieving a house advantage value;

adjusting a second game parameter based on the selected value of the first game parameter and the retrieved house advantage value;

executing a play of the gaming device using the selected value of the first game parameter and the adjusted second game parameter;

determining an outcome of the play; and determining a payout amount based on the outcome.

17. The method of claim 16 wherein the step of adjusting the second game parameter is based on ensuring that the house advantage is approximately equal to a wager amount less a sum of all potential payouts multiplied by the probability of each such potential payout.

18. The method of claim 17, wherein the first parameter comprises a payout parameter of a selected outcome, and wherein the second parameter comprises a probability of the selected outcome.

19. The method of claim 18, and further comprising the step of modifying the probability of a further outcome.

20. The method of claim 19 wherein the further outcome has no associated payout.

21. The method of claim 16 wherein the step of adjusting the second game parameter comprises the step of retrieving a formula to be used in such adjusting step.

22. The method of claim 21 wherein the formula retrieved is dependent on the type of parameter for which a value is received from the player.

23. The method of claim 22 wherein the formula is selected from the group consisting of a compensating probability formula, a payout formula and a wager formula.

24. A video poker machine comprising:

a player input module that receives a modification to a deck of cards from which a hand is dealt;

a parameter modification module that maintains a desired house advantage by modifying a video poker parameter based on the modification to the deck of cards.

25. The video poker machine of claim 24 wherein the modification to the deck of cards is selected from the group consisting of the number of cards in the deck, removal of cards from the deck, and substitution of cards in the deck.

* * * * *